US005483275A

United States Patent [19]

Higashi et al.

[11] Patent Number: 5,483,275

[45] Date of Patent: Jan. 9, 1996

[54] THERMAL PRINTER WITH MEANS FOR REDUCING COLOR SHIFTS

[75] Inventors: Kazuhiko Higashi; Kiyoshi Takakuwa; Kazuaki Arimoto; Kenichi Naruki, all of Hiroshima; Hiroshi Fukumoto, Hyogo; Terumi Kuwada; Keisuke Oda, both of Hiroshima, all of Japan

[73] Assignee: Mitsubishi Denki Kabushiki Kaisha, Tokyo, Japan

[21] Appl. No.: 941,153

[22] Filed: Sep. 4, 1992

[30] Foreign Application Priority Data

Sep. 5, 1991 [JP] Japan ..... 3-226101
Jun. 19, 1992 [JP] Japan ..... 4-161123

[51] Int. Cl.[6] ..... B41J 11/42

[52] U.S. Cl. ..... 347/218; 400/582; 346/134; 346/136

[58] Field of Search ..... 346/134, 136; 400/582; 347/208

[56] References Cited

U.S. PATENT DOCUMENTS 4,912,490 3/1990 Negoro et al. ..... 346/160

FOREIGN PATENT DOCUMENTS 60-165270 8/1985 Japan .
63-272560 11/1988 Japan .

OTHER PUBLICATIONS

"Method for Controlling Paper Feeding" Patent Hitachi Seisakusho; A–57 142 380; Sep. 1982.

"Recording Apparatus"; A–61–144 371; Konishiroku Photo Ind.; Jul. 1986.

"Control Method for Heat Storage of Thermal Head"; A–11 80 365; Shinko Electric Co. Ltd.; Jul. 1989.

*Primary Examiner*—Huan H. Tran
*Attorney, Agent, or Firm*—Leydig, Voit & Mayer

[57] ABSTRACT

A thermal printer includes a memory for storing a correction for cancelling variations in a paper feed caused by a previously determined uneven paper feed, a first calculator for calculating an uneven paper feed in each of the lines to be printed, a second calculator for calculating a correction corresponding to the uneven paper feed calculated by the first calculator; and a control for controlling the paper feed in each of the lines according to the correction calculated by the second calculator.

1 Claim, 21 Drawing Sheets

CORRECTION TABLE 1

| MEDIA | TIMES OF PRINTING | NON-PRINTING DIVISIONAL BLOCKS | | | | PRINTING DIVISIONAL BLOCKS | | | |
|---|---|---|---|---|---|---|---|---|---|
| | | 1 | 2 | 3 | 4 | 1 | 2 | 3 | 4 |
| TYPE 1 | 1 | 0 | 0 | 0 | 0 | 7 | 7 | 7 | 5 |
| | 2 | 0 | 0 | 0 | 0 | 7 | 7 | 7 | 5 |
| | 3 | 0 | 0 | 0 | 0 | 7 | 7 | 7 | 5 |
| | 4 | 0 | 0 | 0 | 0 | 7 | 7 | 7 | 5 |
| TYPE 2 | 1 | 0 | 0 | 0 | 0 | 10 | 9 | 8 | 7 |
| | 2 | 0 | 0 | 0 | 0 | 10 | 9 | 8 | 7 |
| | 3 | 0 | 0 | 0 | 0 | 10 | 9 | 8 | 7 |
| | 4 | 0 | 0 | 0 | 0 | 10 | 9 | 8 | 7 |

FIG. 3

CORRECTION TABLE 1

| MEDIA | TIMES OF PRINTING | NON-PRINTING DIVISIONAL BLOCKS | | | | PRINTING DIVISIONAL BLOCKS | | | |
|---|---|---|---|---|---|---|---|---|---|
| | | 1 | 2 | 3 | 4 | 1 | 2 | 3 | 4 |
| TYPE 1 | 1 | 0 | 0 | 0 | 0 | 7 | 7 | 7 | 5 |
| | 2 | 0 | 0 | 0 | 0 | 7 | 7 | 7 | 5 |
| | 3 | 0 | 0 | 0 | 0 | 7 | 7 | 7 | 5 |
| | 4 | 0 | 0 | 0 | 0 | 7 | 7 | 7 | 5 |
| TYPE 2 | 1 | 0 | 0 | 0 | 0 | 10 | 9 | 8 | 7 |
| | 2 | 0 | 0 | 0 | 0 | 10 | 9 | 8 | 7 |
| | 3 | 0 | 0 | 0 | 0 | 10 | 9 | 8 | 7 |
| | 4 | 0 | 0 | 0 | 0 | 10 | 9 | 8 | 7 |

FIRE STATE

PAPER FEED AMOUNT

CORRECTION AMOUNT
+
0
-

PAPER FEED AMOUNT AFTER CORRECTED
PRINTING ADVANCING DIRECTION

FIG. 5(a)

PRINTING HISTORY TABLE

| BLOCK | DEGREE OF PRINTING |
|---|---|
| 1 | 0 |
| 2 | 1 |
| 3 | 0 |
| 4 | 1 |

→

FIG. 5(b)

PRINTING HISTORY TABLE

| BLOCK | DEGREE OF PRINTING |
|---|---|
| 1 | 0 |
| 2 | 1 |
| 3 | 1 |
| 4 | 1 |

FIG. 5(c)

CORRECTION TABLE 2

| MEDIA | TIME OF PRINTING | CORRECTION AMOUNT |
|---|---|---|
| TYPE 1 | 1 | 5 |
| | 2 | 4 |
| | 3 | 4 |
| | 4 | 3 |
| TYPE 2 | 1 | 3 |
| | 2 | 3 |
| | 3 | 2 |
| | 4 | 1 |

CORRECTION TABLE 3

| ACCUMULATED VALUE OF HEAT AMOUNT | CORRECTION AMOUNT |
|---|---|
| 0~99 | 0 |
| 100~199 | -1 |
| 200~299 | -1 |
| ⋮ | |
| 4900~4999 | -5 |

+
0
−
PRINTING ADVANCING DIRECTION

FIG. 12(a)

| LINE NUMBER | CORRECTION AMOUNT OF PRESENT LINE | THE REMAINDER OF CORRECTION AMOUNT OF PREVIOUS LINE | SUM CORRECTION AMOUNT | CONTROL AMOUNT |
|---|---|---|---|---|
| N | 0.6 | 0.0 | 0.6 | 0 |
| N+1 | 0.6 | 0.6 | 1.2 | 1 |
| N+2 | 0.6 | 0.2 | 0.8 | 0 |
| N+3 | 0.6 | 0.8 | 1.4 | 1 |
| N+4 | 0.6 | 0.4 | 1.0 | 1 |
| SUBTOTAL | 3.0 | — | — | 3 |

FIG. 12(b)

| LINE NUMBER | CORRECTION AMOUNT OF PRESENT LINE | THE REMAINDER OF CORRECTION AMOUNT OF PREVIOUS LINE | SUM CORRECTION AMOUNT | CONTROL AMOUNT |
|---|---|---|---|---|
| N | 1.5 | 0.0 | 1.5 | 1 |
| N+1 | 2.0 | 0.5 | 2.5 | 2 |
| N+2 | 2.5 | 0.5 | 3.0 | 3 |
| N+3 | 3.0 | 0.0 | 3.0 | 3 |
| SUBTOTAL | 9.0 | — | — | 9 |

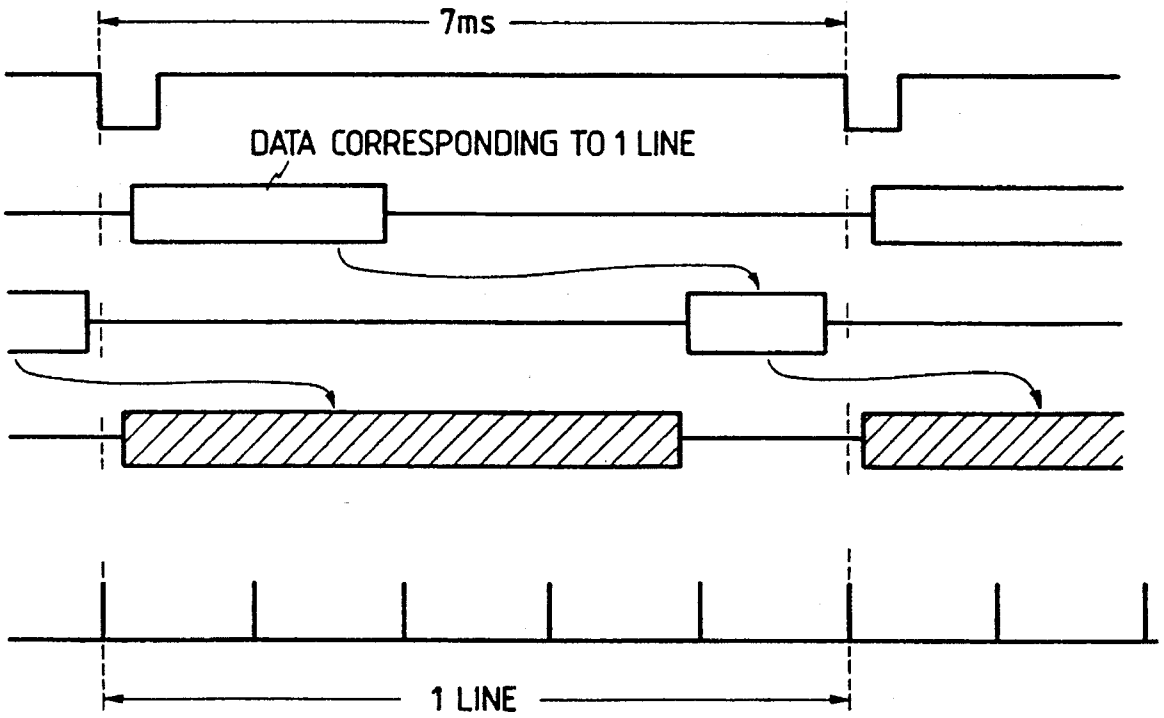
FIG. 15(a) DATA RECEIVING SYNCHRONIZING SIGNAL PRIOR ART
FIG. 15(b) INPUT DATA PRIOR ART
FIG. 15(c) DATA TRANSFER PRIOR ART
FIG. 15(d) OUTPUT DATA PRIOR ART
FIG. 15(e) DRIVE PULSES OF PLATEN MOTOR PRIOR ART $F_1 < F_2$ $\mu_1 > \mu_2$

FIG. 22(a)

| LINE NUMBER | CORRECTION AMOUNT OF PRESENT LINE | CONTROL AMOUNT |
|---|---|---|
| N | 0.6 | 0 |
| N+1 | 0.6 | 0 |
| N+2 | 0.6 | 0 |
| N+3 | 0.6 | 0 |
| N+4 | 0.6 | 0 |
| SUBTOTAL | 3.0 | 0 |

FIG. 22(b)

| LINE NUMBER | CORRECTION AMOUNT OF PRESENT LINE | CONTROL AMOUNT |
|---|---|---|
| N | 1.5 | 1 |
| N+1 | 2.0 | 2 |
| N+2 | 2.5 | 2 |
| N+3 | 3.0 | 3 |
| SUBTOTAL | 9.0 | 8 |

THERMAL PRINTER WITH MEANS FOR REDUCING COLOR SHIFTS

BACKGROUND OF THE INVENTION

1. Field of the Invention

The present invention relates to a thermal printer which precisely adjusts the rate of paper feed to thereby reduce shifting of colors caused by variations in printing rate, frictional force between the paper and a pinch roller, and variations in the diameter of a platen due to thermal expansion.

2. Prior Art

Description will be given below of the structure of a conventional thermal printer with reference to FIGS. 13 and 14. FIGS. 13 and 14 are views which respectively show the electric circuit and mechanism of the conventional thermal printer.

In FIG. 13, the conventional thermal printer comprises an MPU (a micro processor unit) 1 which controls paper feed and the like, a ROM 2 for storing the data of a program and the like, a RAM 3 for temporarily storing data and the like, an input buffer 4 into which data is input, a printing control circuit 5 including a dot counter and the like, an output buffer 6 for outputting data, an ink motor drive circuit 7, an ink motor 8 for feeding an ink sheet, a platen motor drive circuit 9, a platen motor 10 for driving a platen through a belt or the like, and a bus connecting the above circuits with one another.

Also, as shown in FIG. 14, the conventional thermal printer further includes a feeding roller 14 and a winding roller 15 which pass under a head 12 and feed an ink sheet 13, and a platen 16, a pinch roller 17, and rollers 18 and 19 which form a mechanism to feed paper 21 being held between a clamper 20 and the feed mechanism.

Description will be given of the operation of the above-mentioned conventional thermal printer with reference to FIGS. 15(*a*) through 15(*e*), which are timing charts showing the operation of the conventional thermal printer. FIG. 15(*a*) shows a data receiving synchronizing signal, FIG. 15(*b*) shows input data, FIG. 15(*c*) shows data transfer, FIG. 15(*d*) shows output data, and FIG. 15(*e*) shows drive pulses of the platen motor.

As shown in FIGS. 15(*b*) through 15(*d*), data are input in each of lines into the input buffer 4, are then transferred and are finally output to the head 12 while they are shifted by one line. To the head 12 there are input the information on the printing data and a strobe signal on heat generation.

MPU 1 generates a drive pulse of the platen motor 10 in synchronization with the data receiving synchronizing signal. The number of drive pulses to be generated by an output corresponding to one line is a given number and, in FIG. 15(*e*), 5 pulses are shown. Also, an exciting pattern is set to the platen motor drive circuit 9. The platen motor drive circuit 9 in turn outputs the exciting pattern to the platen motor 10 in synchronization with the drive pulse. When the platen motor 10 is driven, then the platen 16 is rotated through a belt and the clamper 20 is moved, thereby feeding the paper 21.

The feeding of the paper 21 is started under the head 12 and travels counterclockwise (round the platen 16) for each color, and rollers 18 and 19. When the paper 21 passes under the head 12, the head 12 is pushed up and, when passing between the platen 16 and pinch roller 17, the pinch roller is opened to thereby allow the clamper 20 to go through. In this operation, the ink sheet 13 is being fed by the ink motor 8 at a constant speed equal to that of the paper 21.

However, the above-mentioned conventional thermal printer has a problem that there is color shifting due to unevenness in the paper feeding. Description will be given below of the main causes of the uneven paper feeding. The main causes include a printing rate, frictional force between the printed surface and a pinch roller, and thermal expansion of the platen.

At first, description will be given of the variations in the amount of paper feeding caused by the printing rate with reference to FIGS. 16(*a*), 16(*b*) and 17(*a*) through 17(*c*). FIG. 16(*a*) and 16(*b*) are views showing part of a mechanism of a conventional thermal printer, and FIGS. 17(*a*) through 17(*c*) are timing charts showing variations of the paper feeding amount caused by the printing rate.

In particular, FIG. 16(*a*) illustrates a state of the paper feeding mechanism of the conventional thermal printer in which no dot is printed, whereas FIG. 16(*b*) illustrates another state thereof in which all dots are printed. The platen 16 is being driven at a constant speed. When printing is not executed, since the ink of the ink sheet 13 is not melted at all, the ink sheet 13 can be easily separated from the paper 21. For this reason, the paper 21 can be drawn with a relatively smaller force.

On the other hand, when printing is executed, since the ink of the ink sheet 13 is melted, it is not easy to separate the ink sheet 13 from the paper 21. This means that the paper 21 must be drawn with a great force. In other words, assuming that a drawing force necessary when no printing is executed is expressed as $F_1$ and a drawing force for printing is expressed as $F_2$, then the following relationship holds for them:

$$F_1 < F_2$$

Although in FIGS. 16(*a*) and 16(*b*) there are shown two extreme cases, the drawing force $F_2$ may vary according to the densities and colors of the paper 21 to be printed.

FIG. 17(*a*) shows a fire state of the head 12, FIG. 17(*b*) shows an amount of paper to be fed per unit time, and FIG. 17(*c*) shows a printing length, respectively, in which the respective abscissas thereof illustrate a printing advancing direction. As shown in FIGS. 17(*a*) through 17(*c*), due to the execution of the printing, the drawing force F increases to thereby increase the paper feed amount as well as the printing length. A dotted line shown in FIG. 17(*c*) represents the variations of the printing length when it is assumed that the paper feed amount is constant. For control of the feed amount, the number of drive pulses of the platen motor 10 during one line printing is set as a given number.

Next, description will be given below of the variations in the paper feed amount caused by a frictional force between a printed surface and a pinch roller with reference to FIGS. 18(*a*) through 18(*d*) and 19(*a*) through 19(*e*). FIGS. 18(*a*) through 18(*d*) are views showing part of a mechanism of a conventional thermal printer, and FIGS. 19(*a*) through 19(*e*) are timing charts showing the variations in the paper feed amount caused by a frictional force between the printed surface and pinch roller of the conventional thermal printer.

In particular, FIGS. 18(*a*) and 18(*b*) illustrate a case in which something is being printed onto the paper 21, and FIGS. 18(*c*) and 18(*d*) illustrate a case in which nothing is being printed onto the paper 21. When printing onto the printed surface, the printed surface provides a greater friction coefficient with respect to the pinch roller 17 because the printed surface is uneven. On the other hand, when printing onto a blank paper surface, the friction coefficient is smaller because the blank paper surface is even. That is, assuming that a friction coefficient between the printed surface and pinch roller 17 is expressed as $\mu_1$ and a friction coefficient between the blank paper surface and pinch roller 17 is expressed as $\mu_2$, then the following relationship holds for them:

$$\mu_1 > \mu_2$$

These friction coefficients have an effect on the printing to be effected on and after the second color.

FIG. 19(*a*) shows a printing state of paper, FIG. 19(*b*) shows a friction coefficient between a pinch roller and a printing surface, FIG. 19(*c*) shows a force to feed paper, FIG. 19(*d*) shows an amount of feeding of paper, and FIG. 19(*e*) shows a printing length, in which the respective abscissas thereof represent a printing advancing direction. As shown in FIGS. 19(*a*) through 19(*e*), since a friction coefficient with respect to the pinch roller 17 increases due to a printed surface, the force to feed the paper 21 decreases, the amount of paper feeding is reduced, and the printing length is shorter than its normal level. That is, the frictional force of the pinch roller 17 acts as a brake on the paper in the feeding direction thereof. A dotted line shown in FIG. 19(*e*) represents the variations of the printing length when it is assumed that the amount of paper feed is constant.

Further, description will be given of the variations of the paper feed amount due to the thermal expansion of a platen with reference to FIGS. 20 and 21. FIG. 20 is a view to show a part of a mechanism of a conventional thermal printer, and FIGS. 21(*a*) through 21(*d*) are timing charts showing the variations in the paper feed amount due to the thermal expansion of a platen employed in the conventional thermal printer.

As shown in FIG. 20, when a heating element of the head 12 generates heat, then the heat is accumulated in the platen 16 to thereby expand the diameter of the platen 16, with the result that the amount of paper feed per line increases.

FIG. 21(*a*) shows a rise in temperature of the platen, FIG. 21(*b*) shows the degree of expansion of the platen, and FIG. 21(*c*) shows a paper feed amount, and FIG. 21(*d*) shows a printing length, in which the respective abscissas thereof represent a printing advancing direction. As shown in FIGS. 21(*a*) through 21(*d*), when the head 12 is heated, then the temperature of the platen 16 rises to thereby increase the expansion of the platen 16. As a result of this, the diameter of the platen 16 increases, whereby the paper feed amount increases and the printing length increases as well. A dotted line shown in FIG. 21(*d*) represents variations in the printing length when it is assumed that the paper feed amount is constant.

SUMMARY OF THE INVENTION

The present invention aims at eliminating the above-mentioned drawbacks found in the conventional thermal printer. Accordingly, an object of the invention is to provide a thermal printer which is capable of reducing the color shift caused by the uneven paper feeding.

Another object of invention is to provide a thermal printer which is capable of controlling paper feed including a correction amount smaller than the minimum paper feed amount of the thermal printer to permit a finer color shift correction control and also which is capable of controlling a fine color shift correction only by adding an algorithm for control to realize a low-cost but high-performance device.

The above object of the present invention is achieved by the provision of a thermal printer which comprises memory means for storing an amount of correction used to cancel variations in an amount of paper feed caused by previously determined uneven paper feed; and paper feed amount control means for finding uneven paper feed in each of lines to be printed, calculating an amount of correction corresponding to the uneven paper feed, and controlling the paper feed amount in each of the lines in accordance with the calculated amount of correction.

Also, a thermal printer according to the invention comprises memory means for storing an amount of correction used to cancel variations in an amount of paper feed caused by a previously determined printing rate; and paper feed amount control means for finding a printing rate of a line to be printed, calculating an amount of correction corresponding to the printing rate, and controlling the paper feed amount of the line in accordance with the calculated amount of correction.

Further, a thermal printer according to the invention comprises memory means for storing an amount of correction used to cancel variations in an amount of paper feed caused by a previously determined frictional force between a printed surface and a pinch roller; and paper feed amount control means for calculating an amount of correction corresponding to a previous printing rate of a line to be printed, and controlling the paper feed amount of the line in accordance with the calculated amount of correction.

Further, a thermal printer according to the invention comprises memory means for storing an amount of correction used to cancel variations in an amount of paper feed caused by a previously determined thermal expansion of the platen; and paper feed amount control means for finding an amount of heat generated in a line to be printed, calculating an amount of correction corresponding to an accumulated amount of heat generated up to the line, and controlling the paper feed amount of the line in accordance with the calculated amount of correction.

Still further, a thermal printer according to the invention comprises memory means for storing an amount of correction including an amount of correction smaller than a minimum control amount to cancel variations in an amount of paper feed caused by previously determined uneven paper feed; and paper feed amount control means for finding the uneven paper feed in each of lines to be printed, for calculating an amount of correction corresponding to the uneven paper feed, and for controlling a paper feed amount an integral number of times the minimum control amount in each of the lines in accordance with the sum of the correction amount of the line being currently printed and the remainder of the correction amount of the previous line.

In a thermal printer according to the invention, memory means is used to store an amount of correction to cancel variations in an amount of paper feed that are caused by previously determined uneven paper feed.

Also, paper feed amount control means is used to find the uneven paper feed in each of lines to be printed, to calculate an amount of correction corresponding to the uneven paper feed thus found, and to control the paper feed amount in each of the lines in accordance with the calculated amount of correction.

In a thermal printer according to the invention, memory means is used to store an amount of correction to cancel variations in an amount of paper feed that are caused by a previously determined printing rate.

Also, paper feed amount control means is used to find the printing rate of a line to be printed, to calculate an amount of correction corresponding to the printing rate, and to control the paper feed amount of the line in accordance with the calculated amount of correction.

In a thermal printer according to the invention, memory means is used to store an amount of correction to cancel variations in an amount of paper feed that are caused by a previously determined frictional force between a printed surface and a pinch roller.

Also, paper feed amount control means is used to calculate an amount of correction corresponding to a previous printing rate of a line to be printed, and to control the paper feed amount of the line in accordance with the calculated amount of correction.

In a thermal printer according to the invention, memory means is used to store an amount of correction to cancel variations in an amount of paper feed that are caused by a previously determined thermal expansion of a platen.

Also, paper feed amount control means is used to find an amount of heat generated in a line to be printed, to calculate an amount of correction corresponding to an accumulated amount of heat generated up to the line, and to control the paper feed amount of the line in accordance with the calculated amount of correction.

Further, in a thermal printer according to the invention, memory means is used to store an amount of correction including an amount of correction smaller than a minimum control amount to cancel variations in an amount of paper feed caused by previously determined uneven paper feed.

Also, paper feed amount control means is used to find the uneven paper feed in each of the lines to be printed, calculate an amount of correction corresponding to the uneven paper feed, and control a paper feed amount an integral number of times the minimum control amount in each of the lines in accordance with the sum of the correction amount of the line being currently printed and the remainder of the correction of the previous line.

BRIEF DESCRIPTION OF THE DRAWINGS

FIG. 3 is a view of a correction table 1 employed in the first embodiment of the invention;

FIGS. 5(*a*)–5(*c*) depict printing history tables and of a correction table 2 employed in the first embodiment of the invention;

FIGS. 12(*a*) and 12(*b*) depict correction tables employed in the third embodiment of the invention;

FIGS. 15(*a*)–15(*e*) are timing charts representing the operation of the conventional thermal printer;

FIGS. 22(*a*) and 22(*b*) depict a correction tables obtained when the algorithm according to the third embodiment of the invention is not used.

DETAILED DESCRIPTION OF THE PREFERRED EMBODIMENTS

Figure 1:
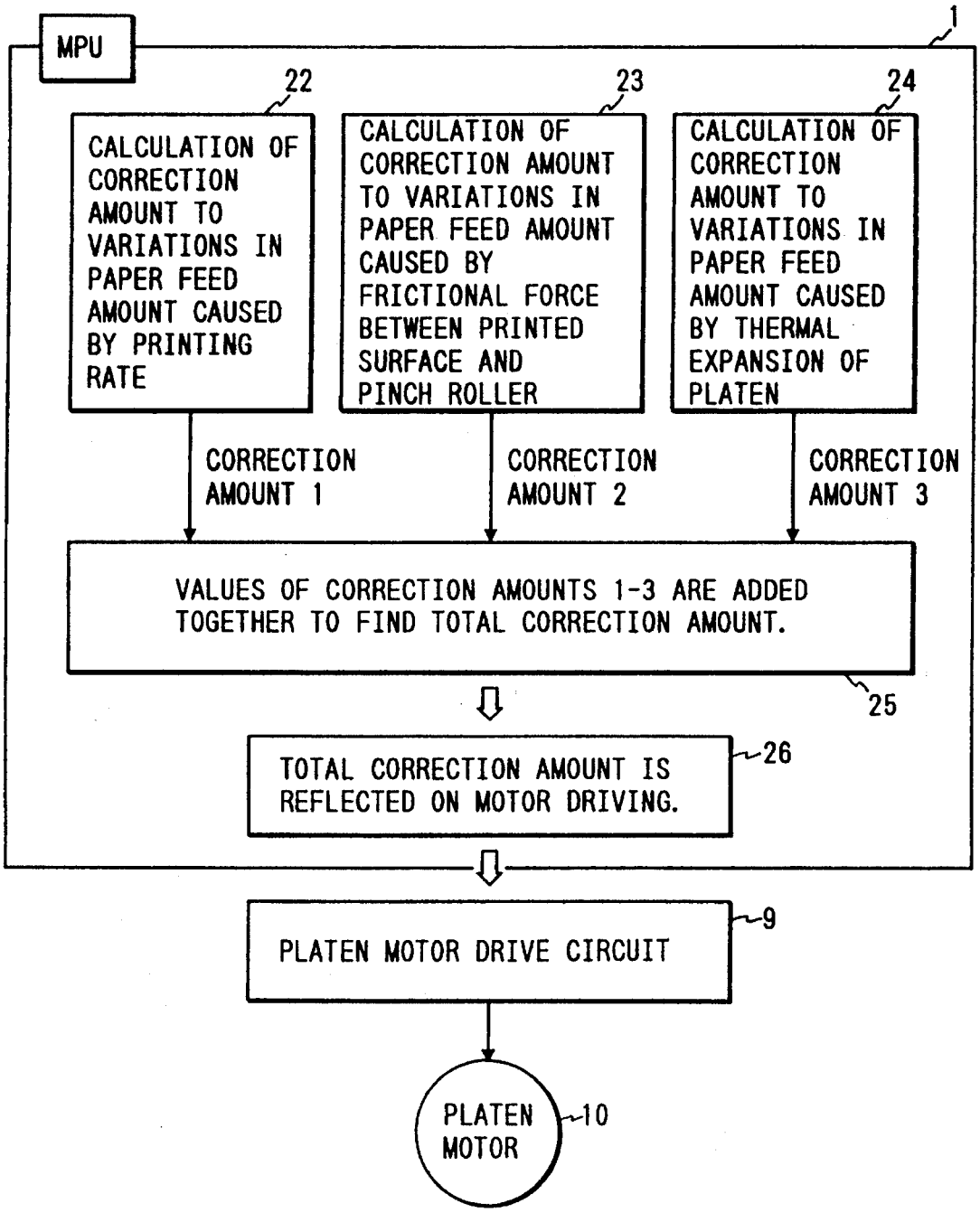
FIG. 1 is a block diagram of a first embodiment of a thermal printer according to the invention.

Description will be given below of the structure of a thermal printer according to a first embodiment of the present invention with reference to FIG. 1. FIG. 1 is a block diagram showing a thermal printer according to an embodiment of the invention, which is the same as the above-mentioned conventional thermal printer in terms of hardware. In a ROM 2, there are registered correction tables 1, 2 and 3 which are obtained by previously simulating the main causes of variations in paper feed amount. It should be noted that like reference characters designate the same or corresponding parts throughout the respective figures.

In this embodiment, a memory means of the invention corresponds to the ROM 2, and a paper feed amount control means of the invention is constituted by an MPU, a platen motor drive circuit 9 and a platen motor 10.

Next, description will be given of the operation of the embodiment with reference to FIGS. 2(*a*) through 2(*f*), which are timing charts showing the operation of the embodiment according to the invention.

Figures 2A, 2B, 2C, 2D, 2E, 2F:
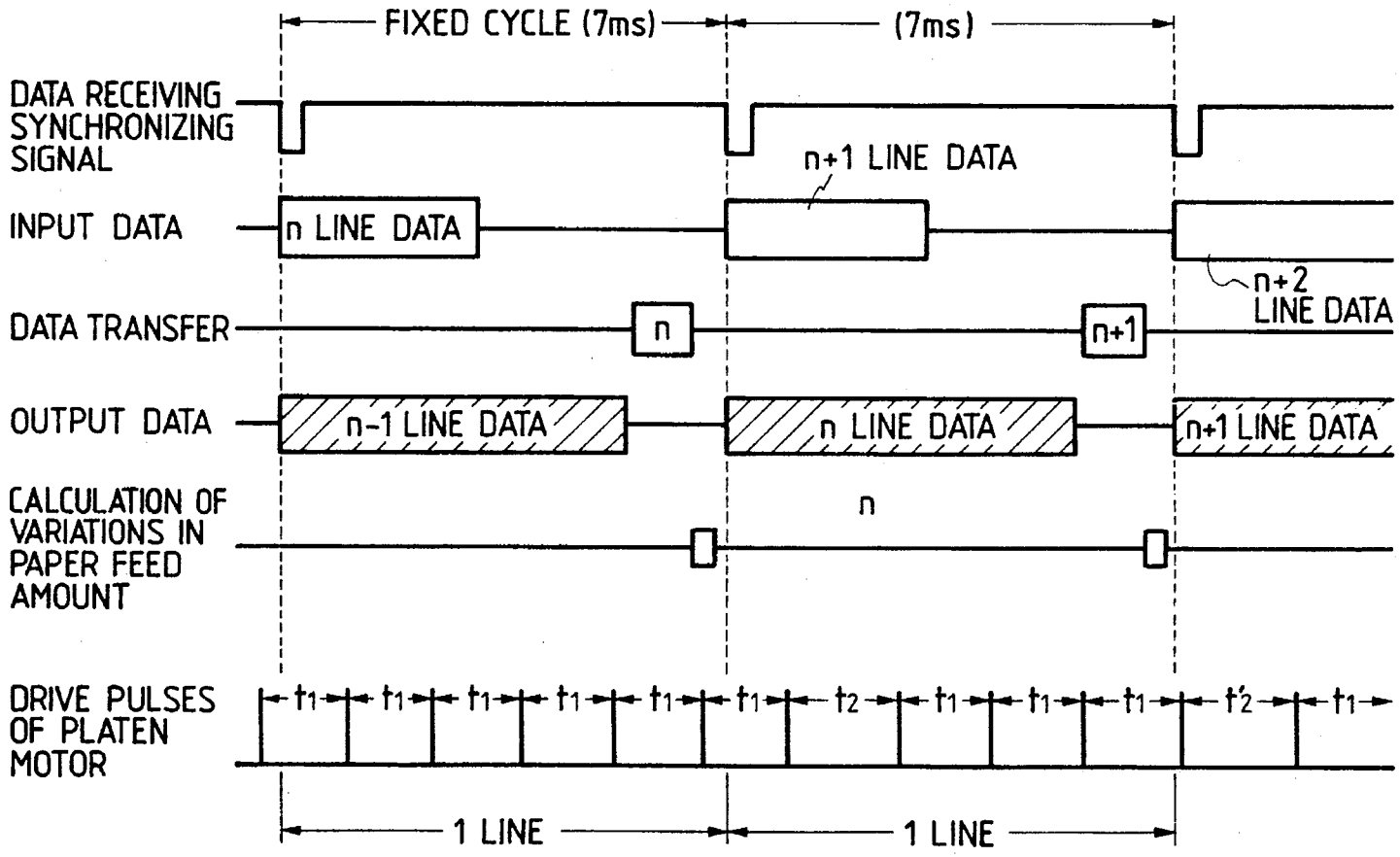
FIGS. 2(*a*)–2(*f*) are a timing charts representing of the operation of the first embodiment of the invention.
Figure 13:
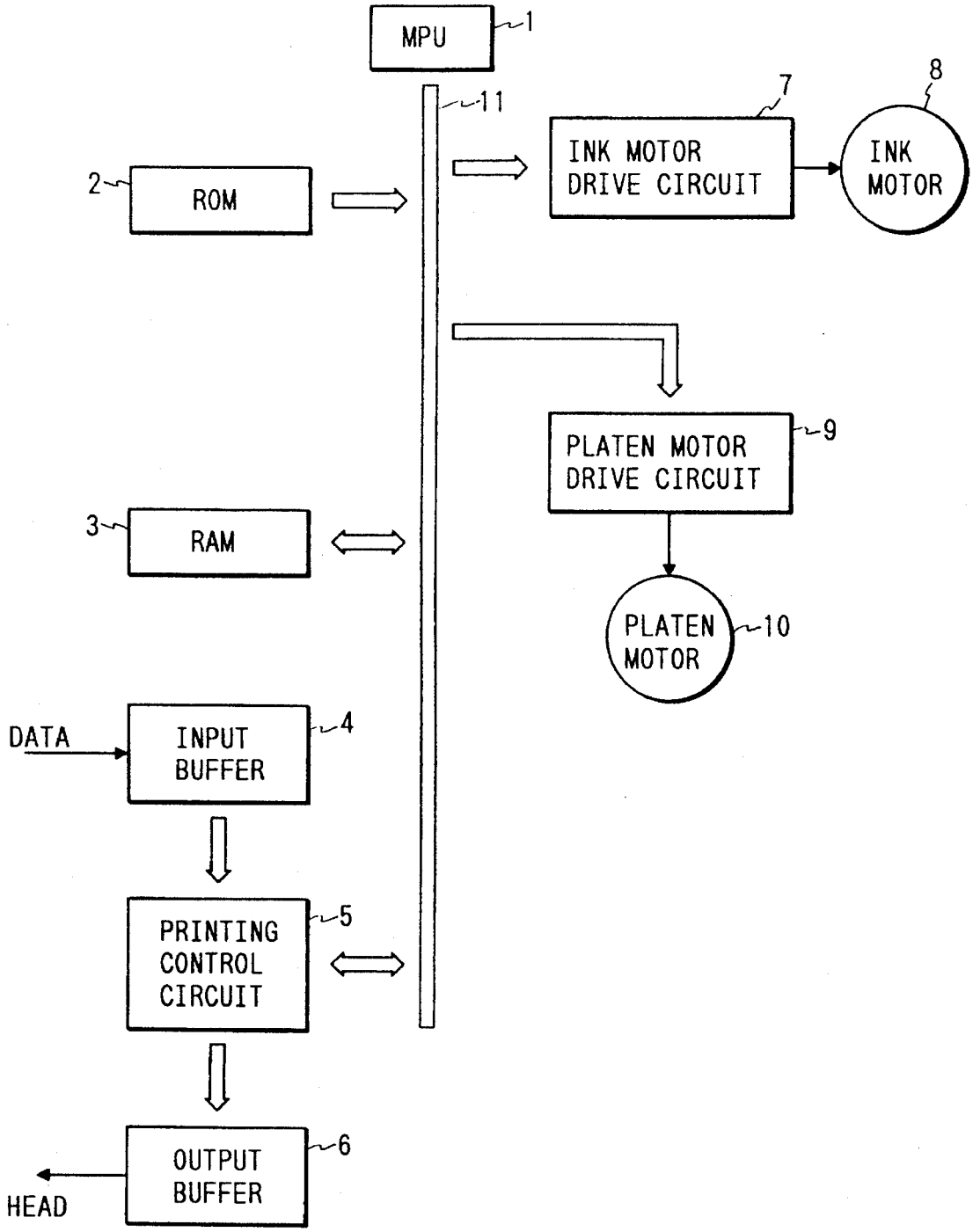
FIG. 13 PRIOR ART
FIG. 13 is an electric circuit diagram of a conventional thermal printer.
Figure 14:
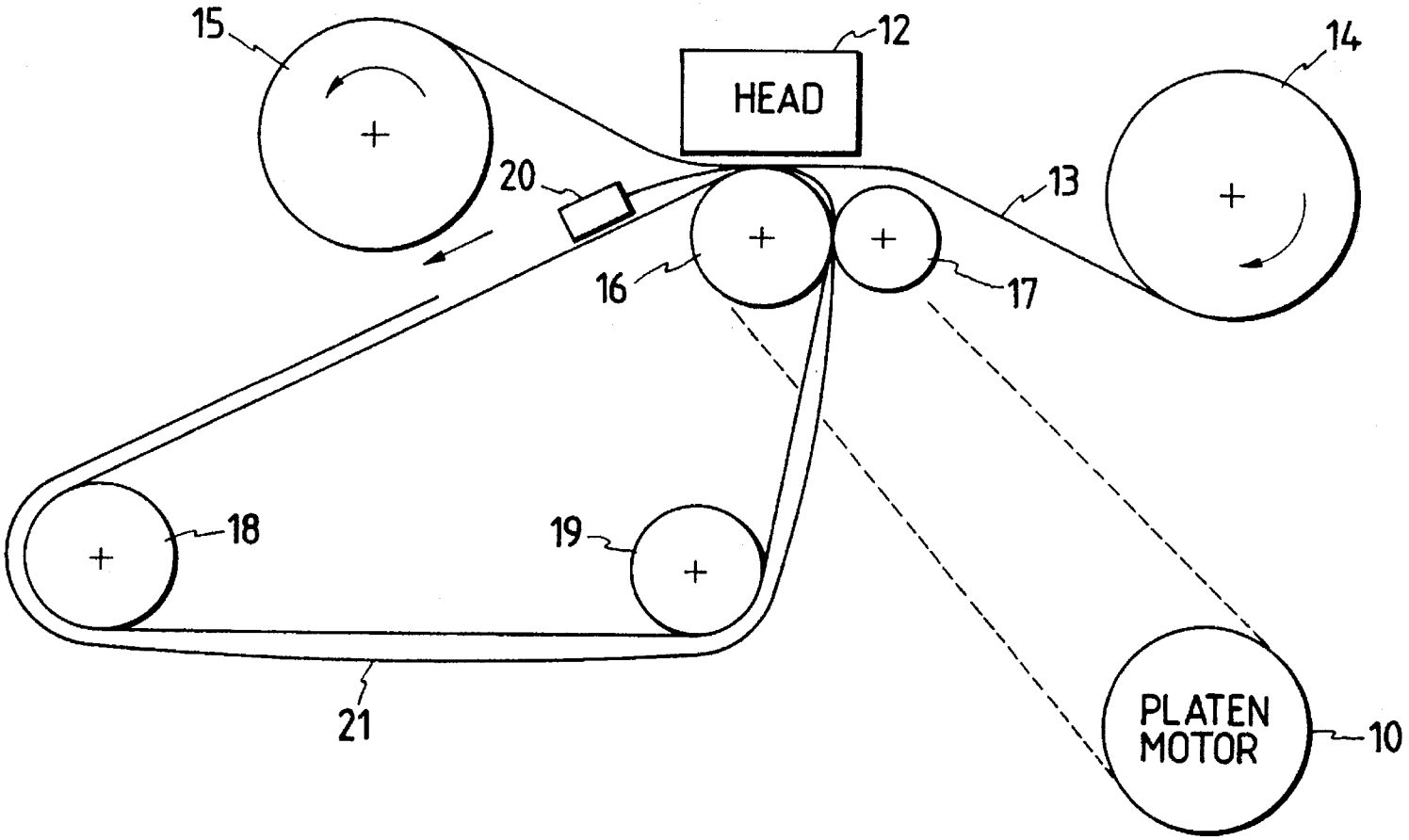
FIG. 14 PRIOR ART
FIG. 14 is a view of a mechanism of the conventional thermal printer.
Figure 16B:
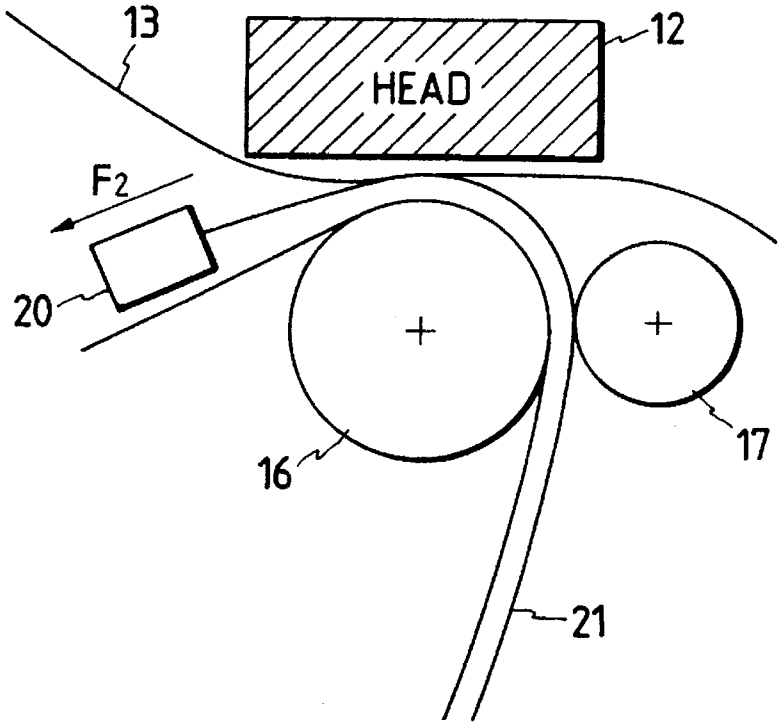
FIG. 16(b) PRIOR ART
FIGS. 16(*a*) and 16(*b*) show a paper feeding mechanism of the conventional thermal printer.
Figure 16A:
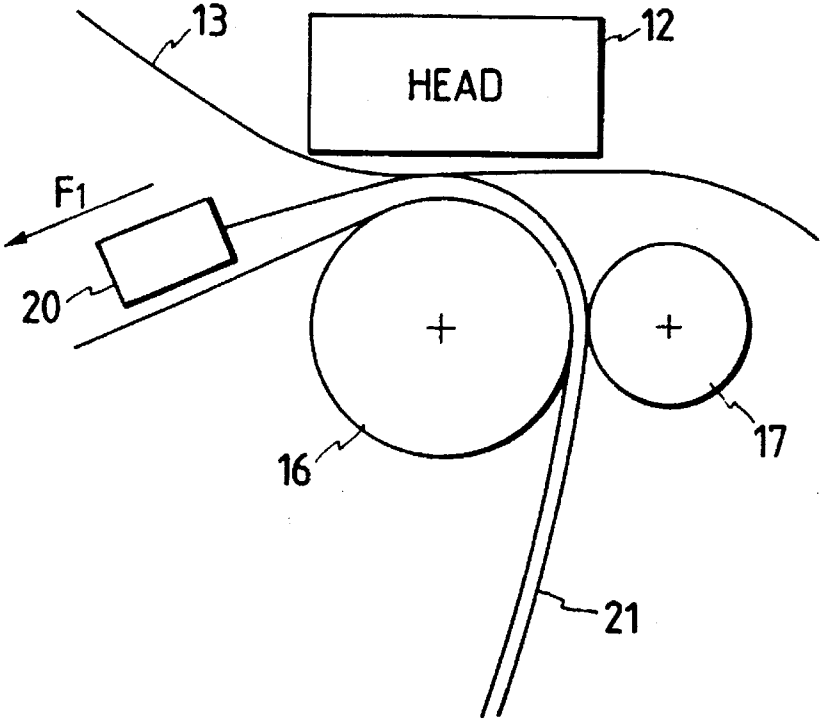
FIG. 16(a) PRIOR ART
Figures 17A, 17B, 17C:
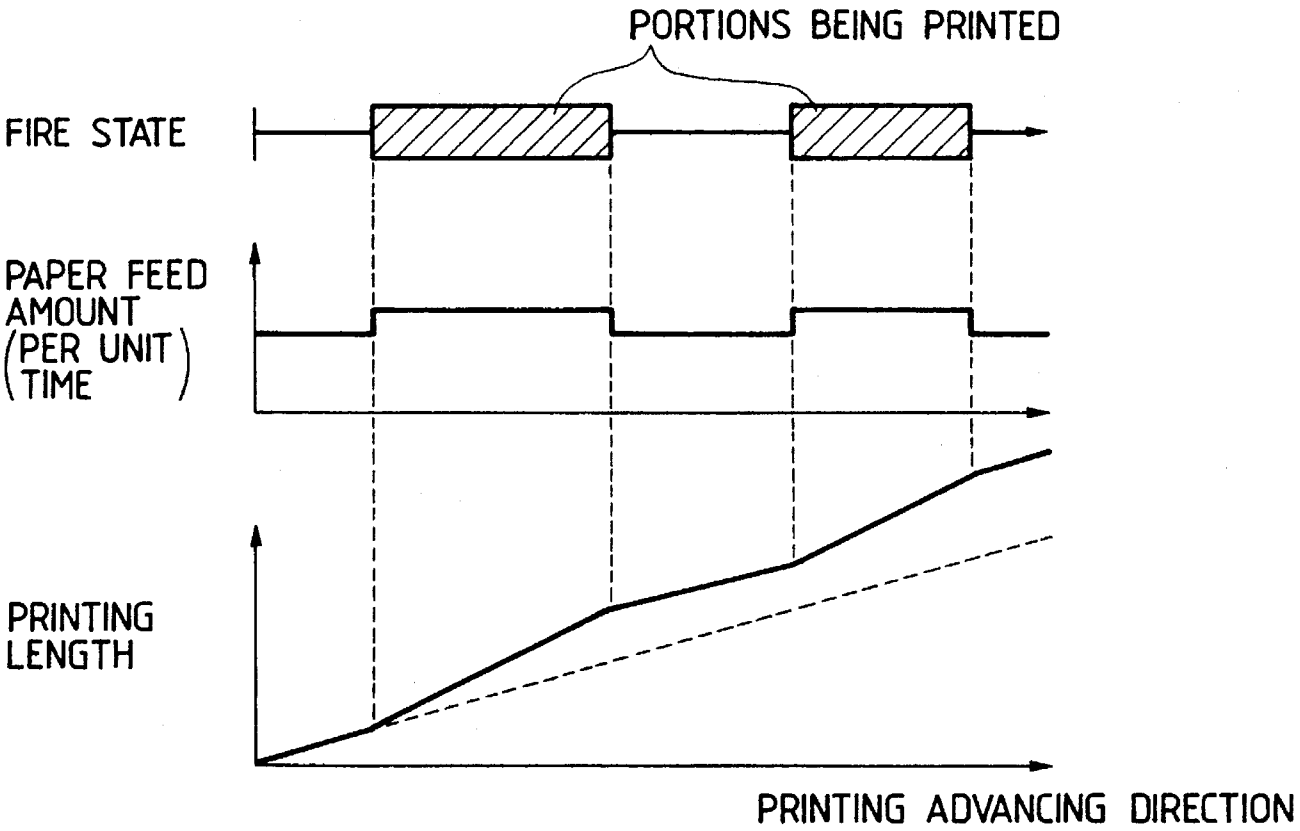
FIG. 17(a) PRIOR ART
FIG. 17(b) PRIOR ART
FIG. 17(c) PRIOR ART
FIGS. 17(*a*)–17(*c*) are timing charts representing variations in a paper feed amount caused by a printing rate in the conventional thermal printer.
Figure 18A:
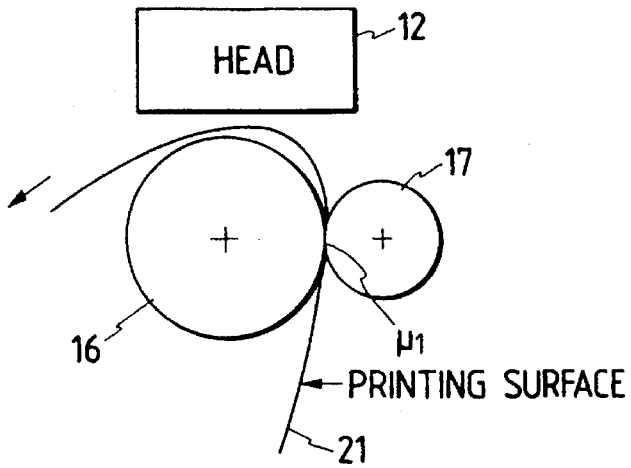
FIG. 18(a) PRIOR ART
FIGS. 18(*a*) to 18(*d*) illustrate part of the mechanism of the conventional thermal printer.
Figure 18B:
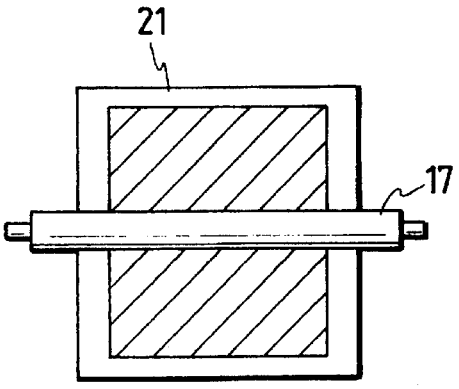
FIG. 18(b) PRIOR ART
Figure 18C:
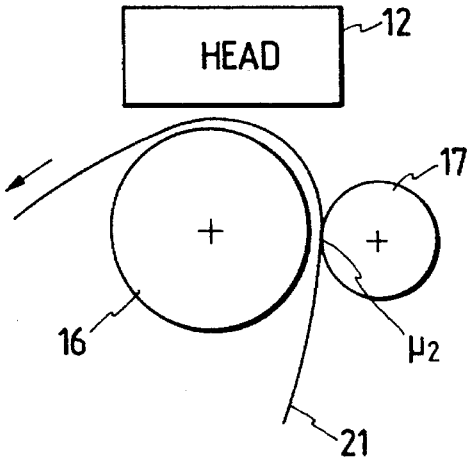
FIG. 18(c) PRIOR ART
Figure 18D:
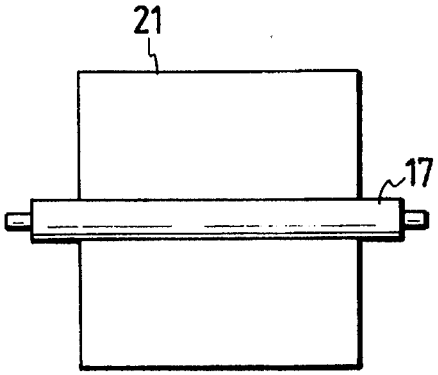
FIG. 18(d) PRIOR ART
Figures 19A, 19B, 19C, 19D, 19E:
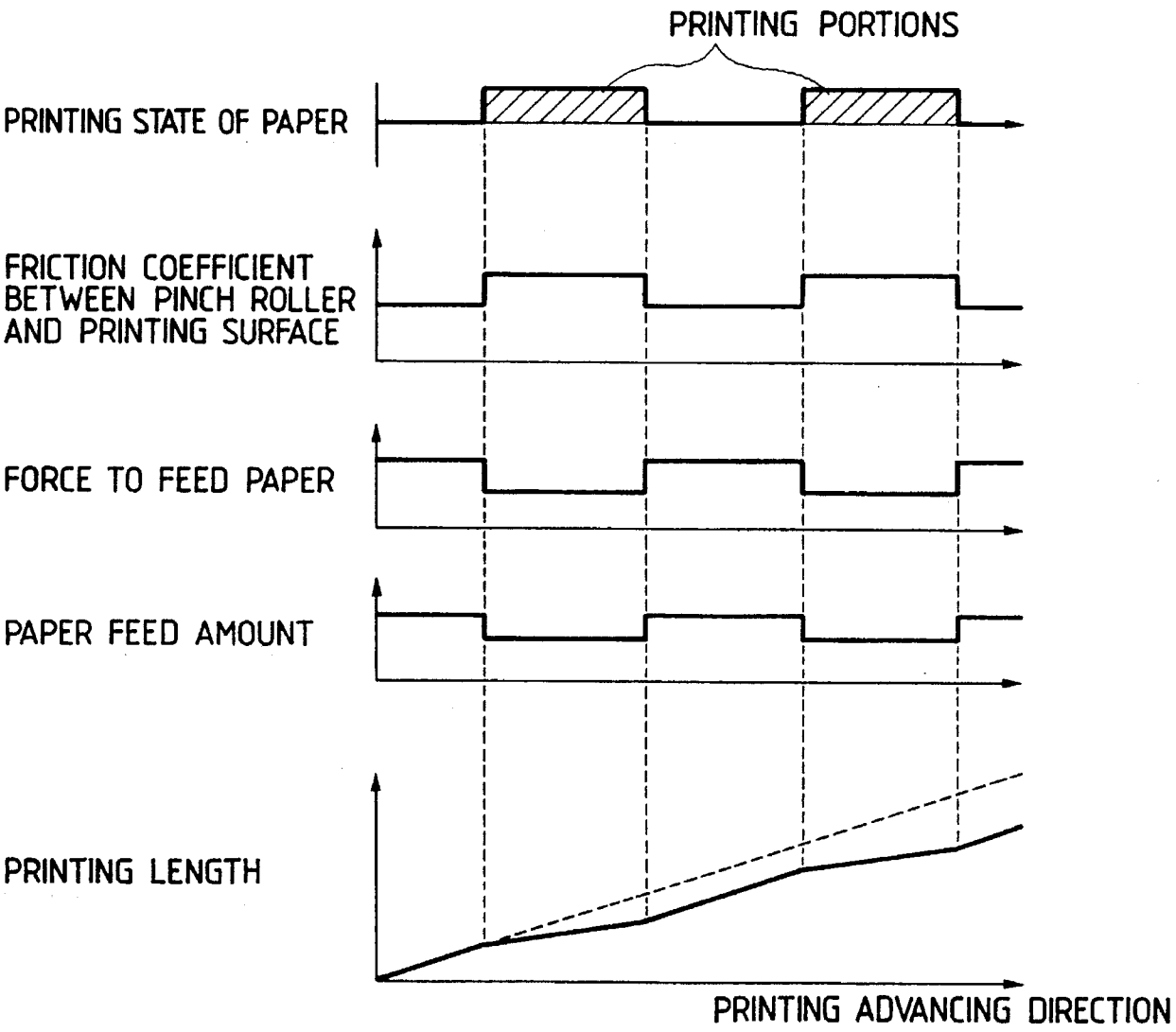
FIG. 19(a) PRIOR ART
FIG. 19(b) PRIOR ART
FIG. 19(c) PRIOR ART
FIG. 19(d) PRIOR ART
FIG. 19(e) PRIOR ART
FIGS. 19(*a*)–19(*e*) are timing charts representing variations in a paper feed amount caused by a frictional force between a printed surface and a pinch roller in the conventional thermal printer.
Figure 20:
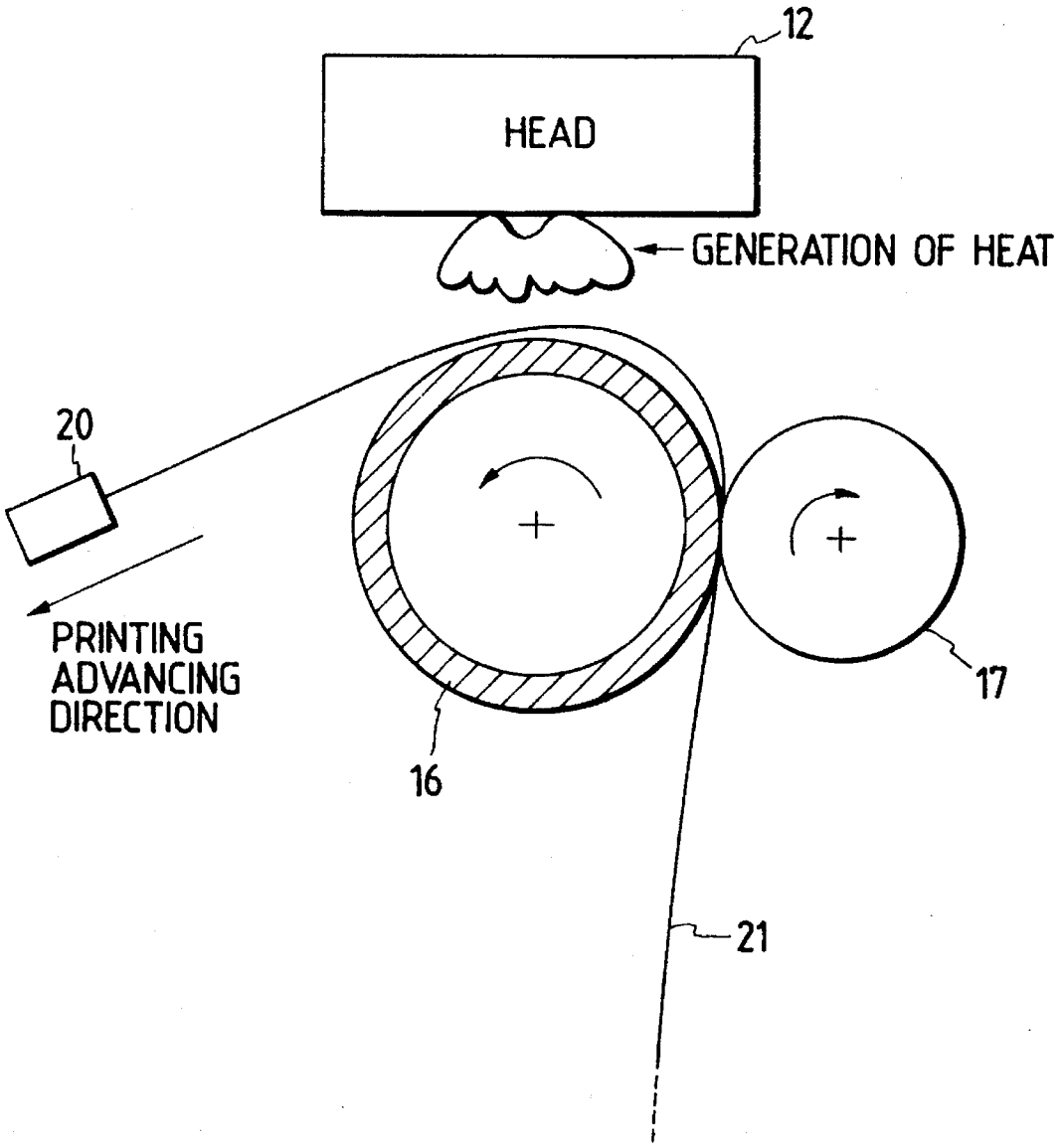
FIG. 20 PRIOR ART
FIG. 20 is a view of a part of the mechanism of the conventional thermal printer; and, FIGS. 21(*a*)–21(*d*) are timing charts representing variations in a paper feed amount caused by the thermal expansion of a platen in the conventional thermal printer.
Figures 21A, 21B, 21C, 21D:
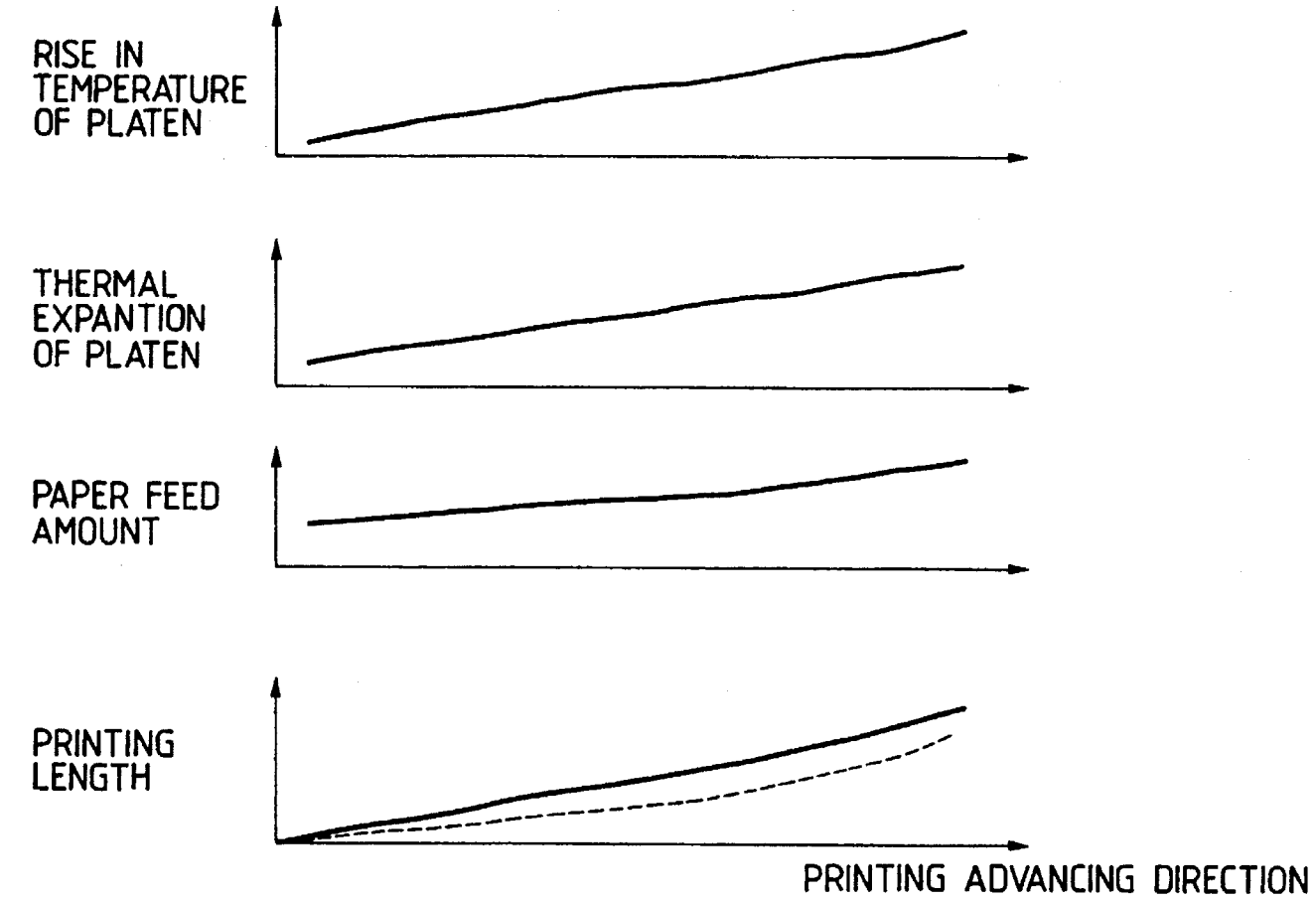
FIG. 21(a) PRIOR ART
FIG. 21(b) PRIOR ART
FIG. 21(c) PRIOR ART
FIG. 21(d) PRIOR ART

As shown in FIGS. 2(*b*) through 2(*d*), input/output and transfer of data is the same as in the conventional thermal printer shown in FIG. 13. As shown in FIG. 2(*e*), variations in the paper feed amount in Steps 22–26 are calculated after the data transfer. And only one of drive pulses in a next line is varied. For example, as shown in FIG. 2(*f*), drive pulses $t_2$, $t_2'$ are the examples to be varied in their respective lines. In other words, by controlling an arbitrary one of a plurality of drive pulses included in a line to vary the number of pulses, the paper feed amount can be controlled. As shown in 2(*f*), the drive pulses of the platen motor 10 are not synchronous with a data receiving synchronizing signal.

At first, a description will be given of the calculation of an amount of a correction 1 with respect to the variations in the paper feed amount that are caused by a printing rate with reference to FIGS. 3 and 4. FIG. 3 shows the correction table 1 which corresponds to the printing rate in the first embodiment according to the invention.

Firstly, the printing rate of a line to be printed is found and an amount of correction 1 corresponding to the printing rate is calculated. The printing rate in each of lines can be found by counting the number of dots in the line by use of a dot counter included in a printing control circuit 5, when the data input is processed. Since the amount of heat (the heat energy) generated in the head 12 is proportional to the product of the number of dots and gradation, the number of dots is found for each gradation. That is, the printing rate expresses the amount of heat of the head 12.

As shown in FIG. 3, in view of memory capacity, the printing rate is divided into two kinds of states, that is, a non-printing state and a printing state. The division depends on how far the respective amounts of heat (the numbers of dots) are from a predetermined value. Also, because the variations in the paper feed amount are different according to the positions of the lines, it is best to find the amount of correction 1 in each of the lines. However, in view of memory capacity, lines forming a screen are divided into a plurality of blocks and then the amount of correction 1 is found in each of the blocks. For example, a first line is included in a division block "1".

The variations in the paper feed amount are also different according to the colors to be printed, that is, according to the number of printing times and, therefore, the amount of correction 1 is found for each of the number of printing times. Further, since the variations are different according to the kinds of media (that is, recording media including paper and the like) as well, it is necessary to find the amount of correction 1 for each of the media. In FIG. 3, there are shown only the amounts of correction 1 that are positive but, however, there are naturally present amounts of correction that are negative.

Figures 4A, 4B, 4C, 4D:
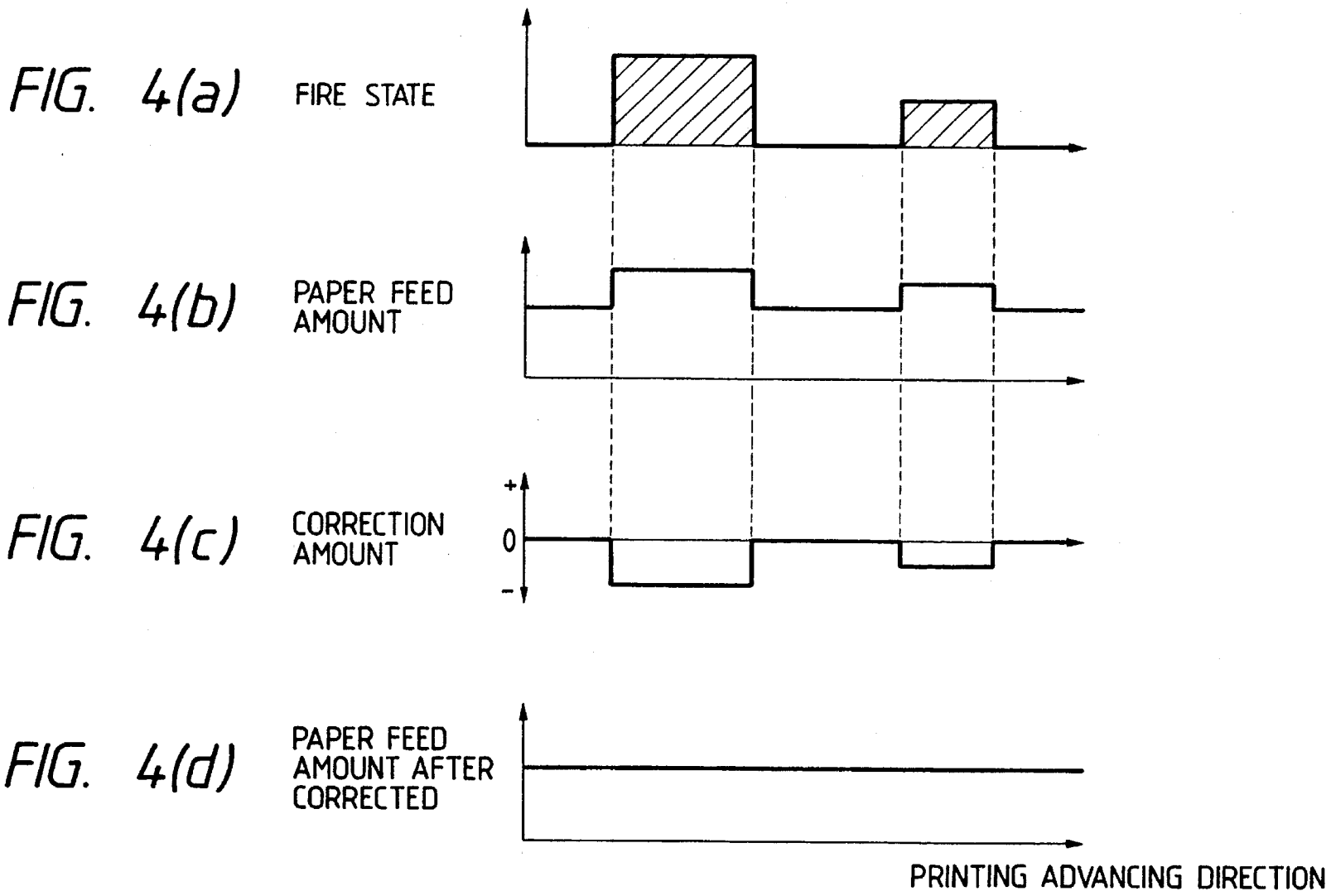
FIGS. 4(*a*)–4(*d*) are a timing charts representing a correcting process based on a printing rate in the first embodiment of the invention.

FIG. 4 is a timing chart to show how to correct the variations in the paper feed amount caused by the printing rate according to the first embodiment of the invention. In particular, FIG. 4(*a*) shows the fire state of the head 12, FIG. 4(*b*) stands for the paper feed amount, FIG. 4(*c*) points out the amount of correction, and FIG. 4(*d*) represents the paper feed amount after correction, respectively. Here, the respective abscissas represent a printing advancing direction. As shown in FIGS. 4(*a*)–4(*c*), since the variations in the paper feed amount are great when the amount of heat is great, the amount of correction 1 is also great correspondingly.

Secondly, description will be given of the calculation of an amount of correction 2 with respect to the variations in the paper feed amount that are caused by frictional force between a printed surface and a pinch roller with reference to FIGS. 5(*a*) through 5(*c*) and 6(*a*) through 6(*d*). FIG. 5 is a view showing printing history tables and a correction table 2 corresponding to the frictional forces between the printed surface and pinch roller in the embodiment 1 according to the invention. In particular, FIGS. 5(*a*) and 5(*b*) respectively show the printing history tables and FIG. 5(*c*) illustrates the correction table 2.

At the first printing, the paper is printed in its blank state and, as shown in FIG. 5(*a*), and there is left a printing history of the printing surface in the printing history table on a RAM 3. It is best to leave the printing history for each of the lines. However, in view of the memory capacity, the printing history is actually divided into four blocks each including 64 lines and the printing history is left in each of the blocks. That is, the number of dots is counted in each of gradations, the counted numbers are accumulated up to 64 lines, and the degree of printing in each of the blocks is described in terms of "0" or "1".

Figures 6A, 6B, 6C, 6D:
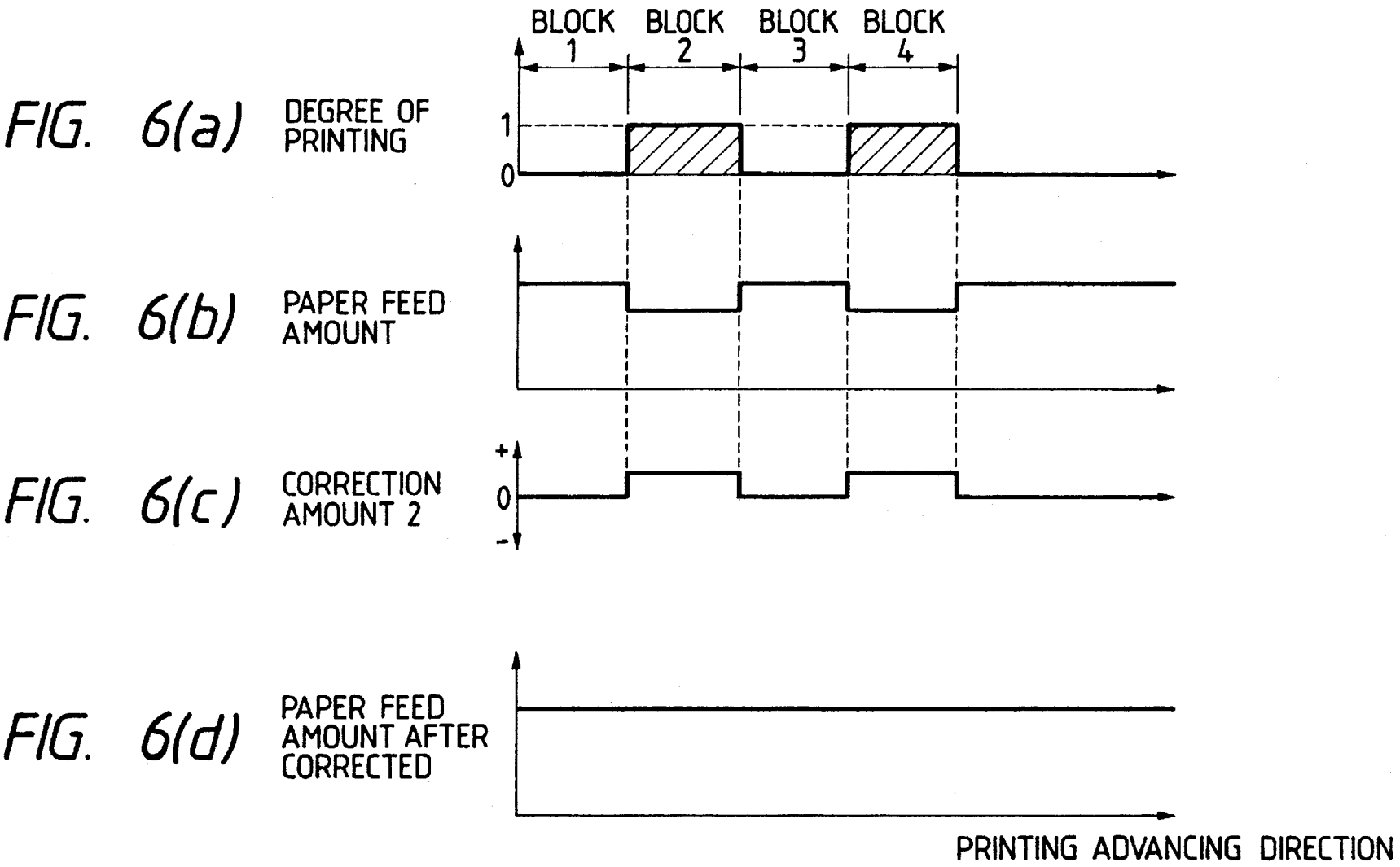
FIGS. 6(*a*)–6(*d*) are timing charts representing a correcting process based on the frictional force of a pinch roller in the first embodiment of the invention.

FIGS. 6(*a*) through 6(*d*) are timing charts to show how to correct the variations in the paper feed amount caused by the frictional force between the printed surface and pinch roller in the first embodiment of the invention. In particular, FIG. 6(*a*) designates the degree of printing, namely, the printing history up to a previous color, FIG. 6(*b*) stands for the paper feed amount, FIG. 6(*c*) points out the amount of correction 2, and FIG. 6(*d*) represents the paper feed amount after correction. The respective abscissas thereof express a printing advancing direction.

In printing a next color, the printing history table is used to refer to the history of the printing of a block to which a line to be printed belongs and, when "0", then no correction is made and a normal paper feed amount is selected. On the other hand, when "1", then there must be selected a paper feed amount with a proper correction taken into consideration. Such processing is shown in FIGS. 6(*a*) through 6(*d*). The amount of correction 2, as shown in FIG. 5(*c*), is selected from the correction table 2 for each of the media and further for each of the numbers of the printings. Here, it should be noted that, in the above next color, printing is made in the blocks 2, 3, and 4.

In this printing of the next color, similarly as in the first printing, the printing history of the printing surface is left in the printing history table. That is, there is provided such a printing history table as shown in FIG. 5(*b*).

Figure 7:
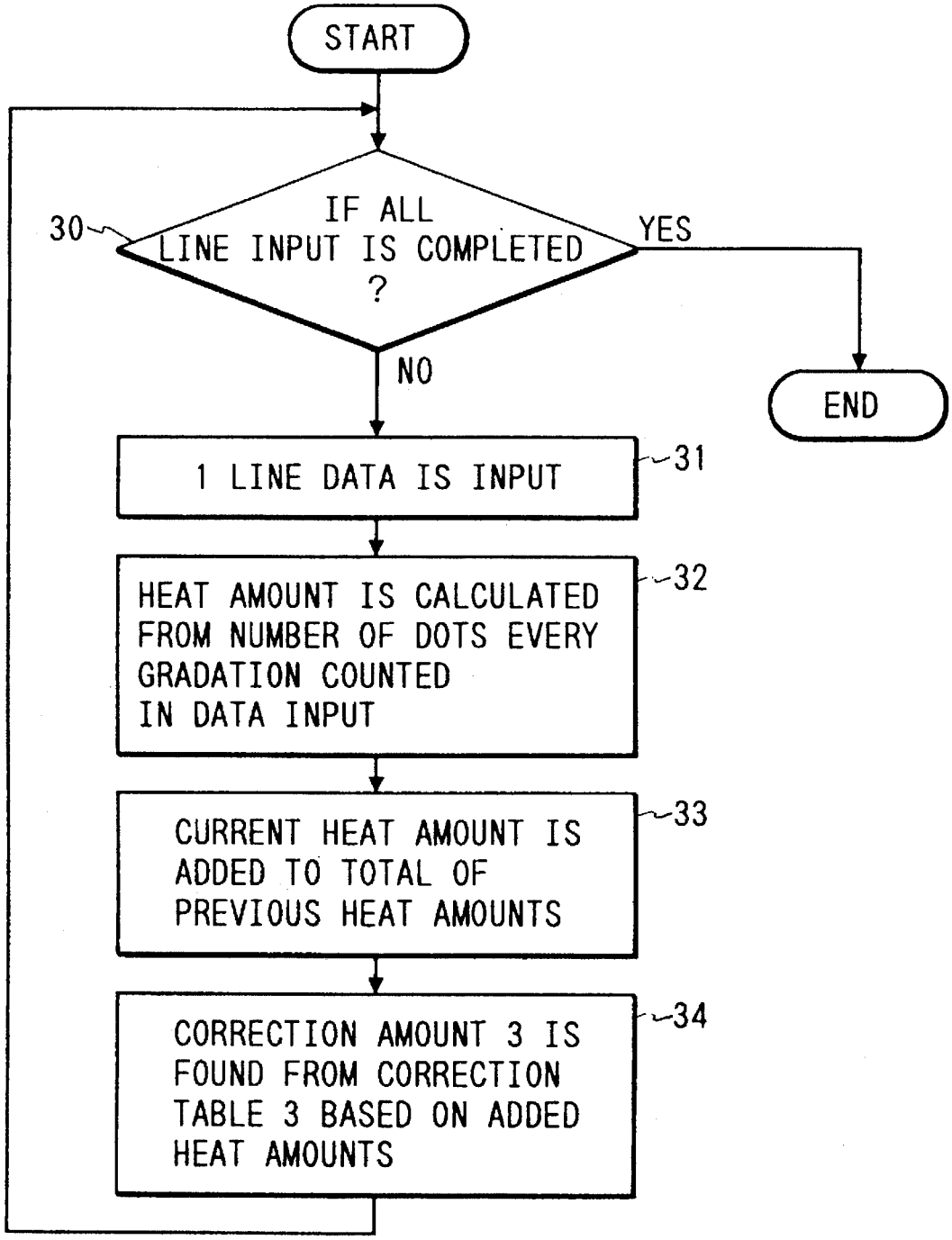
FIG. 7 is a flow chart of a correcting process based on the thermal expansion of a platen in the first embodiment of the invention.
Figures 8, 11:
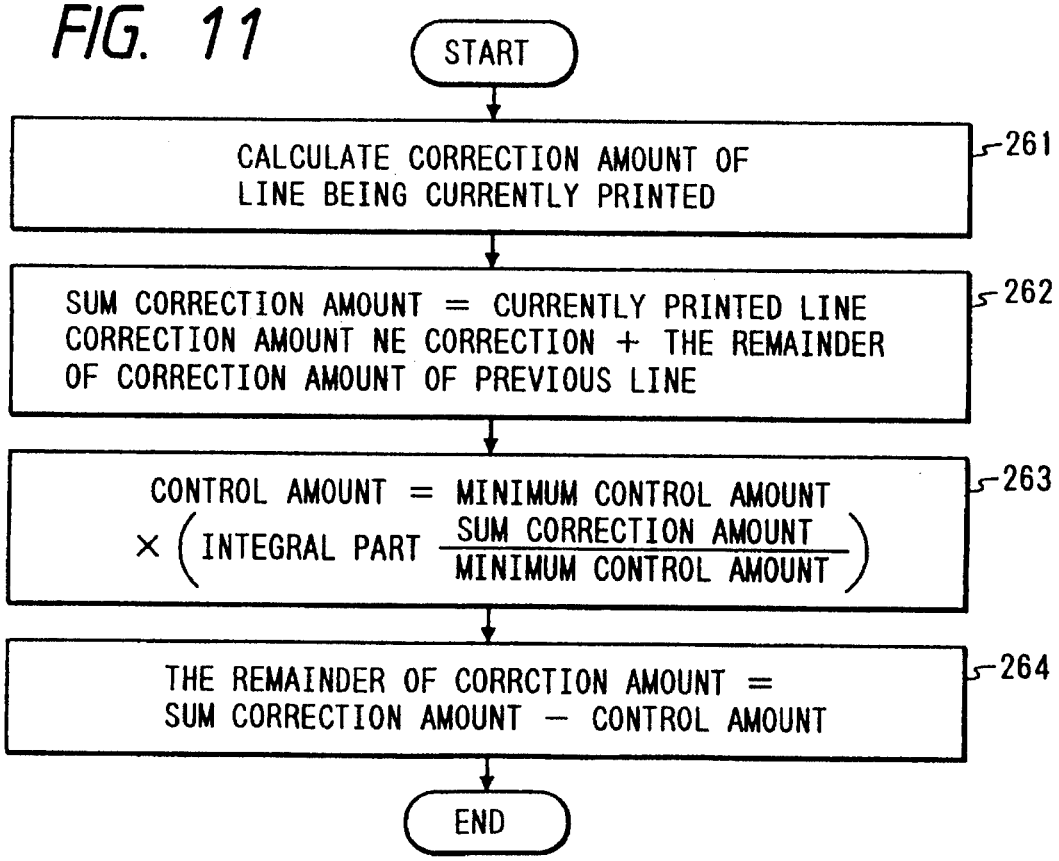
FIG. 8 is a view of a correction table 3 employed in the first embodiment of the invention.
FIG. 11 is a flow chart of an algorithm for calculation of a control amount according to a third embodiment of the invention.

Thirdly, description will be given of the calculation of an amount of correction 3 with respect to the variations in the paper feed amount caused by the thermal expansion of the platen with reference to FIGS. 7, 8 and 9. In FIG. 7, there is shown a flow chart of a correction process with respect to the variations in the paper feed amount caused by the thermal expansion of the platen in the embodiment 1 according to the invention. In FIG. 8, there is shown a correction table 3 which corresponds to the integrated value of amounts of heat generated.

In Step 30, if input of all lines is completed, then this processing is ended and, if not completed, then the processing advances to the next Step 31, in which the data of 1 line is input.

In Step 32, the amount of heat generated is calculated from the number of dots for each gradation that is counted when the data is input. The amount of heat J can be found according to the following equation:

$$J=\alpha(\beta_0 a+\beta_1 b+\beta_2 c+\ldots)$$

where $\alpha$ expresses a coefficient of proportion, $\beta_0$, $\beta_1$, $\beta_2$ . . . represent exponents of heat, and a, b, c . . . respectively stand for the number of dots in each of gradations.

In Step 33, the current amount of heat generated is added to the total of the amounts of heat generated up to the previous time. In Step 34, the amount of correction 3 is found from a correction table 3 shown in FIG. 8 on the basis of the integrated value of the amounts of heat generated. The foregoing processes are repeated for every line until the all line input is completed. Here, the initial temperature of the head 12 can be detected by use of a thermistor which is provided in the head 12. That is, the rise in temperature (that is, the degree of expansion) of the platen 16 is found by means of calculation of the amount of heat of the head 12.

Figures 9A, 9B, 9C, 9D, 9E:
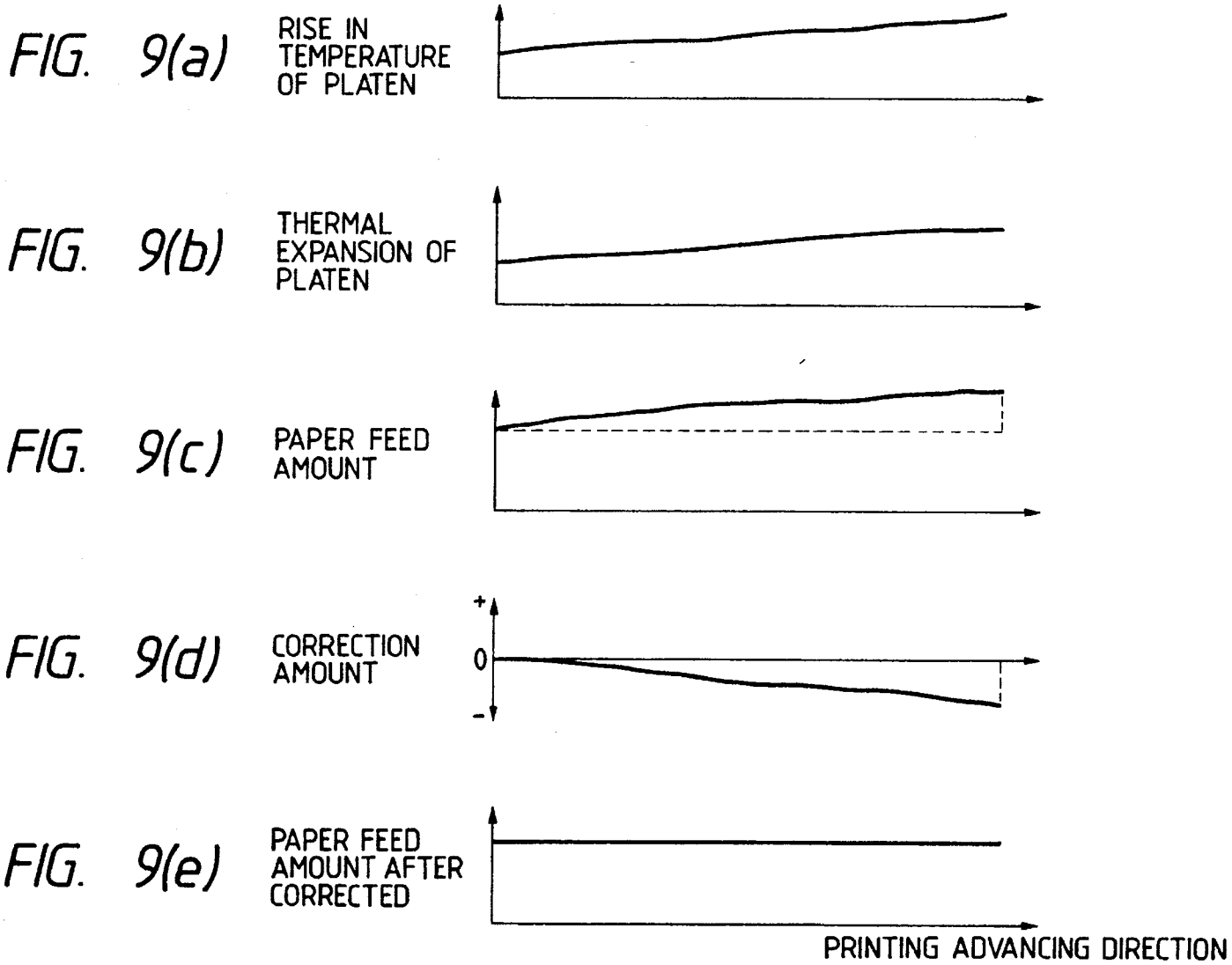
FIGS. 9(*a*)–9(*e*) are timing charts representing a correcting process based on the thermal expansion of the platen in the first embodiment of the invention.

Referring now to FIGS. 9(*a*) through 9(*e*), there is shown a timing chart of a process to correct the variations in the paper feed amount caused by the thermal expansion of the platen according to the first embodiment of the invention. FIG. 9(*a*) represents a rise in temperature of the platen, FIG. 9(*b*) expresses the degree of expansion of the platen, FIG. 9(*c*) stands for a paper feed amount, FIG. 9(*d*) points out an amount of correction, and FIG. 9(*e*) designates a paper feed amount after correction. The respective abscissas represent a printing advancing direction.

Figures 10A, 10B, 10C, 10D, 10E, 10F, 10G, 10H, 10I:
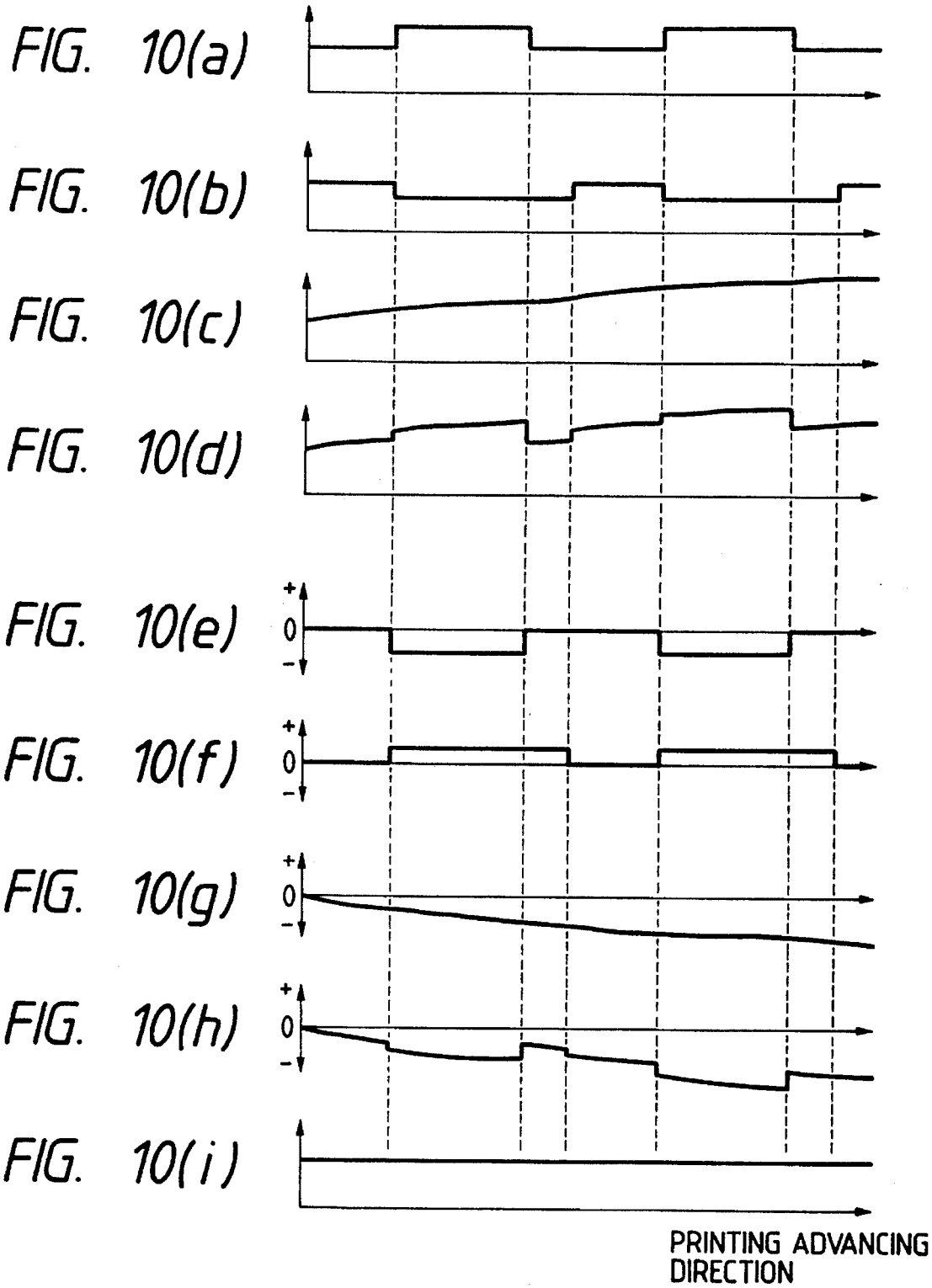
FIGS. 10(*a*)–10(*i*) are timing charts representing a correcting process based on the three main causes in the first embodiment of the invention.

In FIGS. 10(*a*) through 10(*i*), there is shown a timing chart of a process for correcting the whole according to the first embodiment of the invention. FIGS. 10(*a*), 10(*b*) and 10(*c*) respectively stand for the variations in the paper feed amount caused by a printing rate, the frictional force of a pinch roller and the thermal expansion of the platen, while FIG. 10(*d*) points out the variations in the whole paper feed amount. Also, FIG. 10(*e*), 10(*f*) and 10(*g*) respectively represent the amount of correction 1, the amount of correction 2 and the amount of correction 3, while FIG. 10(*h*) stands for the paper feed amount after correction. The respective abscissas thereof represent a printing advancing direction.

As described above, according to whether the printing is made or not, the force necessary for the clamper 20 and platen 16 to feed the paper varies so that the paper feed amount is caused to vary. Also, according to whether the printing was made or not in the previous time, the frictional force (coefficient) between the pinch roller 17 and the printing surface varies so that the paper feed amount is caused to vary. The variations in the paper feed amount per line are slight. However, if paper corresponding to the WB size is printed, then the accumulated amounts of the variations cannot be neglected. Further, the paper feed amount is caused to vary due to the thermal expansion of the platen 16 as well.

In view of the above circumstances, according to the first embodiment of the invention, the printing rate and the rise in temperature of the platen 16 are simulated and, in order to cancel the variations in the paper feed amount in accordance with the simulated results, the paper feed amount is finely adjusted every line. Hence, the embodiment 1 of the invention is able to reduce the color shift that is caused by the variations in the paper feed amount and thus can provide an effect that a color shift adjustment beyond the mechanism adjustment ability of the conventional thermal printer can be realized.

In brief, according to the first embodiment of the invention, in order to reduce color shift due to uneven paper feed, the paper feed amount is finely adjusted every line by simulating the variations in the paper feed amount that are caused by the printing rate, the frictional force between the printed surface and pinch roller, and the thermal expansion of the platen.

Although in the above-mentioned embodiment, the amounts of correction respectively corresponding to the three main causes of the variations in the paper feed amount are integrated into one and then the integrated amount of correction is used to correct the respective variations in the paper feed amount, this is not limiting but the respective main causes may be taken independent, that is, as a second embodiment of the invention, even if the variations in the paper feed amount due to the respective main causes are corrected independently each other, then a sufficient effect can be provided.

In the above-mentioned embodiment of the invention, description has been given of a case in which the present invention is applied to a sublimation type thermal printer having gradations. However, since the paper feed amount is controlled according to whether the printing is made, the present invention can also be applied to other types of thermal printers such as a fusion type thermal printer which has no gradation.

A thermal printer according to a third embodiment of the invention will be described with reference to FIGS. 11 and 12.

FIG. 11 is a flow chart which shows the operation of the thermal printer according to the third embodiment, and FIG. 12 shows correction tables respectively employed by the thermal printer of FIG. 11. It should be noted that FIG. 11 is used to illustrate the details of the contents of Step 26 in FIG. 1, that is, FIG. 11 shows an algorithm for calculation of a control amount in driving a motor in the thermal printer according to the invention.

FIG. 12(*a*) shows an example when the amount of correction is 0.6 and FIG. 12(*b*) shows an example when the amount of correction increases 0.5 each time starting from 1.5.

Referring to FIG. 22(*a*), there is shown an example when the amount of correction is 0.6 but the algorithm in FIG. 11 is not used. In FIG. 22(*b*), there is shown an example when the amount of correction increases 0.5 each time starting from 1.5 but the algorithm in FIG. 11 is not used.

In FIG. 11, the control amount for motor driving can be calculated in the following manner. At first, in Step 261, the correction amount of the line being currently printed is found. The resultant correction amount is the sum correction amount that is illustrated in Step 25 shown in FIG. 1.

In Step 262, the sum correction amount is found. The sum correction amount is the sum of the above-mentioned line being currently printed and the remainder of the correction amount of the previous line.

In Step 263, the control amount is then found. The control amount to be reflected on the motor driving can be obtained by dividing the above-mentioned sum correction amount by the minimum control amount and multiplying the integral part of the divided result by the minimum control amount. This is a control amount which is an integral number of times the minimum control amount and thus it is nearest to the sum correction amount.

In Step 264, the remainder of the correction amount is finally found. The remainder can be obtained by subtracting the above-mentioned control amount from the above-mentioned sum correction amount. The foregoing operations constitute the algorithm for calculation of the control amount.

In FIG. 12(*a*), it is assumed that the minimum control amount is "1". Also, it is assumed that an amount of correction per line is 0.6. As shown in FIG. 12(*a*), referring to the control amount of the N line, because the remainder of the correction amount of the previous line is 0.0, the sum correction amount is 0.6. Therefore, the control amount is 0 and also the remainder of the .correction amount is 0.6.

Referring to the control amount of the N+1, because the remainder of the correction amount of the previous line is 0.6, the sum correction amount is 1.2 and the control amount is 1. The remainder of the correction amount is 0.2. Accordingly, if the control amounts are calculated similarly in the following lines, then there can be obtained such contents as shown in FIG. 12(*a*) in which the control amount of the five lines is 3.

As shown in FIG. 22(*a*), when the above-mentioned algorithm is not used, then the control amount is always 0 regardless of what number of lines are printed and no correction is possible, because the correction amount of the current line is smaller than 1 which is the minimum control correction amount.

In FIG. 12(*b*), it is assumed that the minimum control amount is "1" similarly to the above-mentioned example. Also, it is assumed that the correction amount of one line increases 0.5 each time starting from 1.5. If a similar calculation to the above-mentioned example is executed, then the control amount of the four lines subtotals 9.

As shown in FIG. 22(*b*), in the example where the above-mentioned algorithm is not used, as a result of the calculation, the control amount subtotals 8. This shows that errors due to omission of the control amount have been accumulated.

As has been described above, according to the third embodiment of the invention, a RAM 3 or the like is used to store an amount of correction including an amount of correction smaller than the minimum control amount to cancel variations in the amount of paper feed caused by previously determined uneven paper feed. Also, an MPU 1 or the like is used to find the uneven paper feed in each of lines to be printed, calculate the sum correction amount of the correction amount including the correction amount smaller than the minimum control amount corresponding to the uneven paper feed and the remainder of the correction amount of the previous line, calculate the remainder of the correction amount of the paper feed amount in each of the lines in accordance with the thus calculated sum correction amount, and controls the paper feed amount for each of the lines. The third embodiment is able to correct such an amount smaller than the minimum control amount of the device and thus is able to reduce the color shift that is caused by an uneven paper feed.

As was described above, a thermal printer according to the invention comprises memory means which stores an amount of a correction used to cancel variations in an amount of paper feed that are caused by previously determined uneven paper feed, and paper feed amount control means which finds the uneven paper feed in each of lines to be printed, calculates an amount of correction corresponding to the uneven paper feed, and controls the paper feed amount in each of the lines in accordance with the calculated amount of correction, whereby the present thermal printer provides such an effect that it can reduce the color shift that is caused by the uneven paper feed.

A thermal printer according to the invention comprises memory means which stores an amount of a correction used to cancel variations in an amount of paper feed caused by a previously determined printing rate, and paper feed amount control means which finds a printing rate of a line to be printed, calculates an amount of correction corresponding to the printing rate, and controls the paper feed amount of the line in accordance with the calculated amount of correction, whereby the present thermal printer provides such an effect that it can reduce the color shift that is caused by the uneven paper feed.

A thermal printer according to the invention comprises memory means which stores an amount of correction used to cancel variations in an amount of paper feed caused by a previously determined frictional force between a printed surface and a pinch roller, and paper feed amount control means which calculates an amount of correction corresponding to a previous printing rate of a line to be printed, and controls the paper feed amount of the line in accordance with the calculated amount of correction, whereby the present thermal printer provides such an effect that it can reduce the color shift that is caused by the uneven paper feed.

A thermal printer according to the invention comprises memory means which stores an amount of correction used to cancel variations in an amount of paper feed caused by a previously determined thermal expansion of a platen, and paper feed amount control means which finds an amount of heat generated in a line to be printed, calculates an amount of correction corresponding to an accumulated amount of heat generated up to the line, and controls the paper feed amount of the line in accordance with the calculated amount of correction, whereby the present thermal printer provides such an effect that it can improve the color shift that is caused by the uneven paper feed.

As has been described hereinbefore, a thermal printer according to the invention comprises memory means for storing the correction amount including the correction amount smaller than the minimum control amount to cancel the variations in the paper feed amount caused by the previously determined uneven paper feed, and paper feed amount control means for finding the uneven paper feed in each of lines to be printed, for calculating the correction amount that corresponds to the uneven paper feed, and for controlling the paper feed amount an integral number of times the minimum control amount in accordance with the sum correction amount which is the sum of the correction amount of the line being currently printed and the remainder of the correction amount of the previous line. With this structure, the present thermal printer is able to correct such a control amount smaller than the minimum control amount of the device and is thus able to reduce the color shift that is caused by the uneven paper feed.

What is claimed is:

1. A thermal printer comprising:

memory means for storing a correction for cancelling variations in a paper feed caused by a previously determined uneven paper feed;

first calculation means for calculating an uneven paper feed in each of several lines to be printed;

second calculation means for calculating a correction corresponding to the uneven paper feed calculated by said first calculation means; and means for controlling the paper feed in each of the several lines according to the correction calculated by said second calculation means and to the correction stored in said memory means.

* * * * *